United States Patent [19]

Lankheet

[11] 4,343,118

[45] Aug. 10, 1982

[54] REMOVABLE SWIMMING POOL CONSTRUCTION

[76] Inventor: Jay A. Lankheet, 1320 Bayview Ave., Holland, Mich. 49423

[21] Appl. No.: 87,743

[22] Filed: Oct. 24, 1979

[51] Int. Cl.[3] ..... E04H 3/16; E04H 3/18

[52] U.S. Cl. ..... 52/169.7

[58] Field of Search ..... 52/169.7, 169.8; 4/506, 4/488

[56] References Cited

U.S. PATENT DOCUMENTS

| | | | |
|---|---|---|---|
| 3,440,780 | 4/1969 | Adam | 52/169.8 |
| 3,444,659 | 5/1969 | Shanni | 52/169.8 |
| 3,820,174 | 6/1974 | Rozawski | 52/169.7 |
| 3,975,874 | 8/1976 | Witte | 52/169.8 |
| 3,991,530 | 11/1976 | Scourtes | 52/169.7 |
| 4,020,509 | 5/1977 | West | 52/169.7 |
| 4,124,907 | 11/1978 | Laven | 52/169.7 |
| 4,205,499 | 6/1980 | Lankheet | 52/169.7 |

*Primary Examiner*—John E. Murtagh

*Attorney, Agent, or Firm*—Price, Heneveld, Huizenga & Cooper

[57] ABSTRACT

The specification discloses a removable swimming pool comprising a plurality of side wall panels and deck panels, a flexible liner, and a facing member, which is connected between the deck and side wall panels, and extends around the inside marginal edge of the pool. The facing member depends from the deck panels to a point disposed normally adjacent to the water line of the pool, and overlies an upper portion of the liner to alleviate deterioration and damage thereto. A plurality of braces are provided to support the deck panels thereon and simultaneously anchor the side wall panels in the ground.

18 Claims, 7 Drawing Figures

REMOVABLE SWIMMING POOL CONSTRUCTION

BACKGROUND OF THE INVENTION

The present invention relates to swimming pools, and in particular to a prefabricated or modularized swimming pool construction.

Removable swimming pools have become increasingly popular for use with private homes, as a result of their reduced cost, flexible usage, and pleasant, permanent-like appearance. Such pools are of a partially-in-ground design, and include a plurality of relatively short side wall panels, and deck panels which are prefabricated and interconnected to fashion a frame for supporting a flexible, imperforate liner in a depression formed in the ground. The deck and side wall panels support the liner in a predetermined contour, which in turn forms the water retaining reservoir.

The liner for removable swimming pools preferably extends above the water line of the pool, so as to form a reliable, water-tight design. However, these chemicals, such as chlorine, and the like, which are added to the swimming pool water to treat the same, tend to cause the liner to deteriorate very quickly at that portion of the liner which extends below the deck panels and above the water line. This portion of the liner is continually wetted by the chemically-treated pool water, and is directly exposed to both the sunlight and the air, thereby embrittling the liner and causing it to crack. Further, this exposed upper portion of the liner is particularly susceptible to inadvertent damage from physical impact, such as that caused by bathers as they grasp the side of the pool and/or push off from the side of the pool, as well as impact with floating toys, skimming tools, and other such objects. The combination of the above noted factors frequently causes the pool liner to fail prematurely at the exposed upper portion, thereby requiring a costly and time-consuming repair.

SUMMARY OF THE INVENTION

The present invention provides a facing member for removable swimming pools, and is connected between the deck and side wall panels of the pool, overlies the upper portion of the flexible liner and extends downwardly to a point positioned normally adjacent to the water line of the pool to alleviate deterioration and damage to the liner. The facing member includes a resilient portion which urges the facing member securely against the upper portion of the liner.

Another aspect of the present invention is to provide a plurality of braces which support the deck panels thereon, and simultaneously anchor the side wall panels in the ground.

These and many other important advantages of the invention will be further understood and appreciated by those skilled in the art by reference to the following written specification, claims, and appended drawings.

DETAILED DESCRIPTION OF THE PREFERRED EMBODIMENTS

Figure 1:
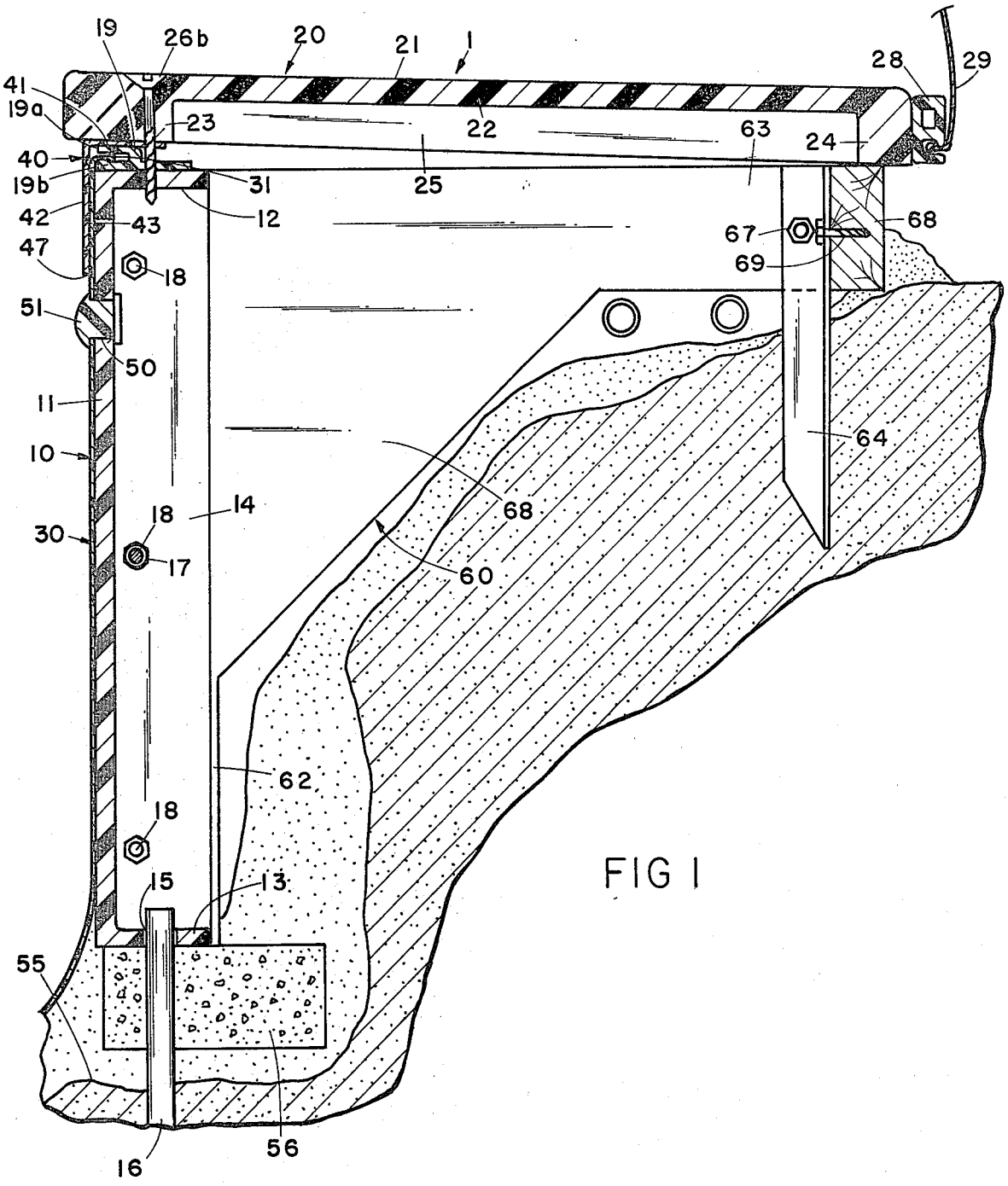
FIG. 1 is a vertical cross-sectional view of a removable swimming pool construction embodying the present invention.

For purposes of description herein, the terms "upper", "lower", "right", "left", "rear", "front", "vertical", "horizontal", and derivatives thereof shall relate to the invention as oriented in FIG. 1. However, it is to be understood that the invention may assume various alternative orientations, except where expressly specified to the contrary.

The reference numeral 1 (FIG. 1) generally designates a removable swimming pool construction embodying the present invention, comprising a plurality of side wall panels 10 and deck panels 20, a flexible liner 30, and a facing member 40 which is connected between the side wall and deck panels 10 and 20, and extends around the inside marginal edge of the pool. The facing member 40 depends from the deck panels 20 to a point disposed normally adjacent to or slightly below the water line of the pool, and overlies an upper portion of the liner 30 to alleviate deterioration and damage thereto. A plurality of braces 60 are provided to support the deck panels 20 thereon and simultaneously anchor the side wall panels 10 in the ground.

The side wall panels 10 (FIG. 1) are interconnected to form a marginal frame for supporting the flexible liner 30. In the illustrated example, the side wall panels 10 are rectangular in shape, and include a forward plate 11 oriented toward the inside portion of the pool, and upper and lower flanges 12 and 13 respectively, as well as opposing end flanges 14. The lower flange 13 of each of the side wall panels 10 includes at least two spaced apart, vertically oriented apertures 15 which are adapted to telescopically receive therein an anchor rod 16 for purposes to be described in greater detail hereinafter. The end flanges 14 of each of the side panels includes three apertures 17 therethrough, which are spaced regularly along the length of the end flange, and are adapted for alignment with mating apertures in the brace member 60, and are shaped for receiving fasteners 18 therethrough for interconnecting adjacent side panels in an end-to-end fashion.

A retainer 19 (FIG. 6) is connected with the upper surface of the upper flange 12, and is shaped to connect the liner 30 with the frame structure. The illustrated retainer 19 is channel-shaped, and includes upper and lower flanges **19*a* and 19*b* which are disposed in a substantially parallel relationship, with the free ends thereof spaced apart slightly to form a gap 19*c* between which the free edge of the liner 30 is inserted. A rear channel wall 19*d* interconnects the upper and lower retainer flanges 19*a* and 19*b*, and a base 19*e* extends rearwardly of the channel along a plane substantially coincident with the lower flange 19***b*, to provide means for attaching retainer 19 to the side wall upper flange 12. In this example, retainer 19 is in the nature of an extruded aluminum channel, and extends along the length of each of the side wall panels 10 at the upper, forward corner thereof, and is substantially flush with the outer surface of the front plate 11. The retainer 19 may be connected with the side wall upper flange 12 by suitable fasteners, such as screws (not shown).

Figure 2:
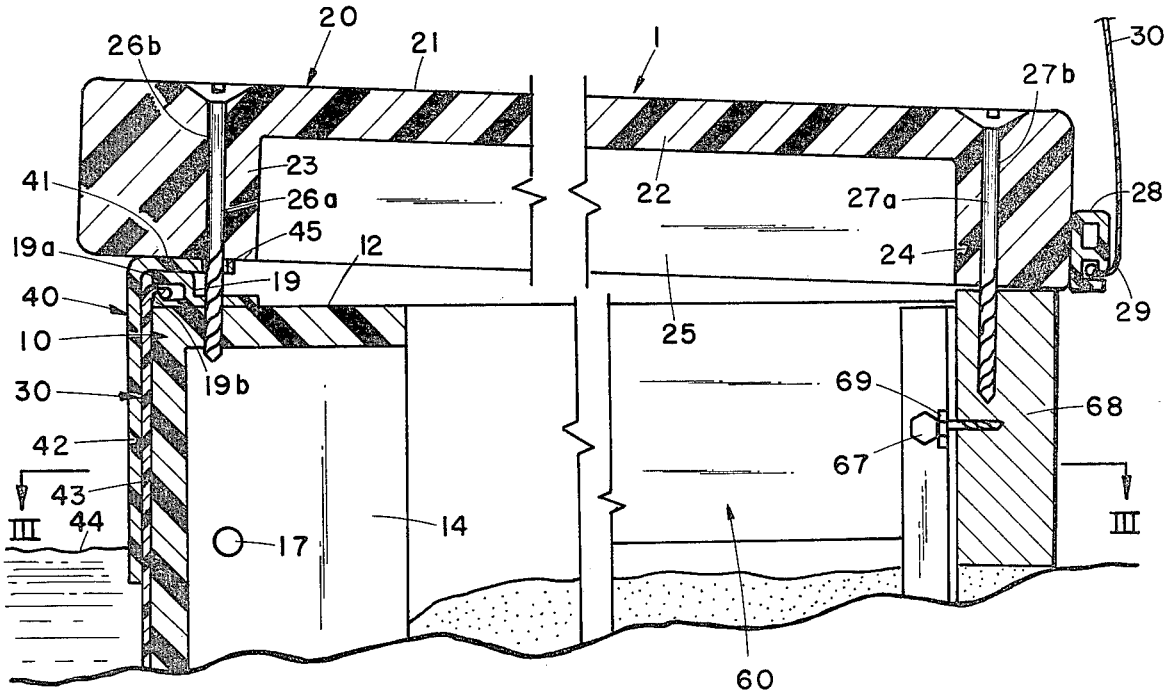
FIG. 2 is an enlarged, fragmentary cross-sectional view of the swimming pool construction.

The deck panels 20 (FIG. 2) extend about the marginal edge of the pool, and include an upper surface 21 thereof which is adapted for non-slip engagement with the feet of the users to facilitate ingress and egress from the pool. The illustrated deck panels 20 have a substantially rectangular shape, and include an upper plate 22, forward and rearward side flanges 23 and 24 respectively, and opposing end flanges 25. The deck panel forward flanges 23 are slightly thicker than the rear flanges 24, and are adapted to overlap or extend over the forward edge of the side wall panels 10. A plurality of vertically-oriented apertures 26*a* are provided in the forward flange 23, extend therethrough, and are spaced regularly along the side of the deck panel. The apertures 26*a* are shaped to receive a fastener 26*b* therein having a countersunk head, so as not to obstruct the deck surface. In a similar manner, the rearward flange 24 includes a plurality of spaced-apart apertures 27*a*, which are shaped to receive mating fasteners 27*b* therein. A channel-shaped retainer 28 is connected with the exterior surface of the rearward flange 24 along the bottom edge thereof, and is adapted to receive and clampingly retain therein the free edge portion of a flexible pool enclosure 29, which shall be described in greater detail hereinafter.

Figure 3:
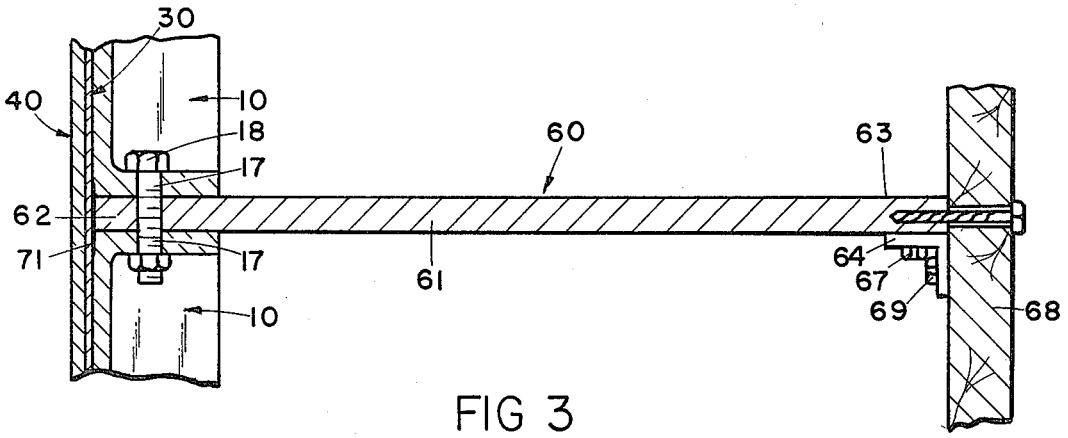
FIG. 3 is a fragmentary horizontal cross-sectional view of the swimming pool construction taken along the line III—III, FIG. 2.
Figure 4:
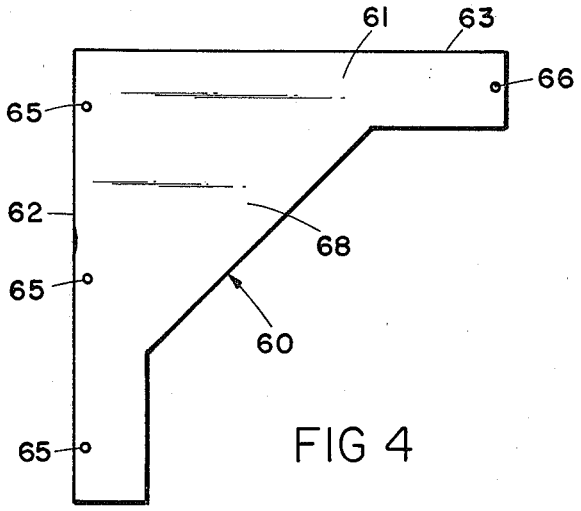
FIG. 4 is a side elevational view of a brace portion of the swimming pool construction.

Both the side wall panels 10 and deck panels 20 are preferably integrally formed of a rigid, water impervious material, such as a synthetic resin reinforced with glass fiber. The side wall panels 10 and deck panels 20 are anchored in place by a plurality of brace members 60, which as best illustrated in FIGS. 3 and 4, comprises a substantially flat plate 61 having a forward leg 62 thereof connected between a pair of adjacent side wall panels 10 at an inward side of the pool construction, and a second leg 63 which extends radially outwardly beneath the deck panels 20, and includes an exterior end thereof connected with a rear ground anchor 64. The forward leg 62 includes three spaced-apart apertures 65 which are aligned with the side wall end flange apertures 17, and receives the fasteners 18 therethrough. The upper leg 63 also includes an aperture 66 therethrough to receive fastener 67 therein to attach the ground anchor 64 to the brace 60. The brace 60 includes a medial portion 68 which is triangular in shape and is formed integrally with the brace legs 62 and 63, and provides means for fixedly retaining the brace legs in a predetermined angular relationship. The braces 60 securely support the side wall panels 10 in a substantially vertical plane located at a predetermined height above the bottom of the pool.

A support rail 68 (FIG. 1) extends along the outer periphery of the pool frame and is connected with the upper leg 63 of each of the braces 60 by means such as fasteners 69, thereby interconnecting each of the braces 60 in the pool structure and adding rigidity to the frame. After the pool has been installed in the ground, dirt is backfilled against the exterior surface of the support rail 68, thereby imparting a permanent appearance to the swimming pool construction.

The illustrated rear ground anchor 64 (FIGS. 1 and 3) is in the nature of an L-shaped metal stake having the upper end thereof connected with both the brace 60 and the rail 68, with the lower end thereof sharpened to a point to facilitate driving the anchor into the ground. The rear anchor 64 may also comprise a treated wooden stake (not shown) which may form a portion of the shipping pallet in which the removable swimming pool construction is transported.

The facing member 40 (FIG. 2) is connected between the side wall panels 10 and deck panels 20, and extends around the inside marginal edge of the pool construction, overlying the upper portion of the flexible liner to alleviate deterioration and damage thereto. The illustrated facing member 40 is an elongate, substantially L-shaped member which includes one leg 41 thereof disposed between the deck and side wall panels 20 and 10, and the other leg 42 depending therefrom and overlying the upper, exposed portion 43 of the liner 30, which is defined herein as that liner portion which extends between the lower surface of the deck panel 20 and the surface of the water 44. The first and second facing legs 41 and 42 are disposed substantially horizontally and vertically respectively when installed in the illustrated removable pool construction. The vertical leg 42 extends downwardly from the deck panels 20 to a point disposed normally adjacent to or slightly below the surface of the water 44. The horizontal leg 41 (FIG. 6) is disposed between the lower surface of deck panels 20 and the upper flange 19*a* of retainer 19, and further includes apertures 45 therethrough to receive therein the fasteners 26*b*. When the pool construction is fully assembled, the fasteners 26*b* simultaneously interconnect the deck panels 20, facing member 40, retainer 19, and side wall panels 10. In the illustrated example, the threaded ends of the fasteners 26*b* are retained in apertures formed in the side wall upper flange 12, at a location adjacent the forward plate 11.

Figure 7:
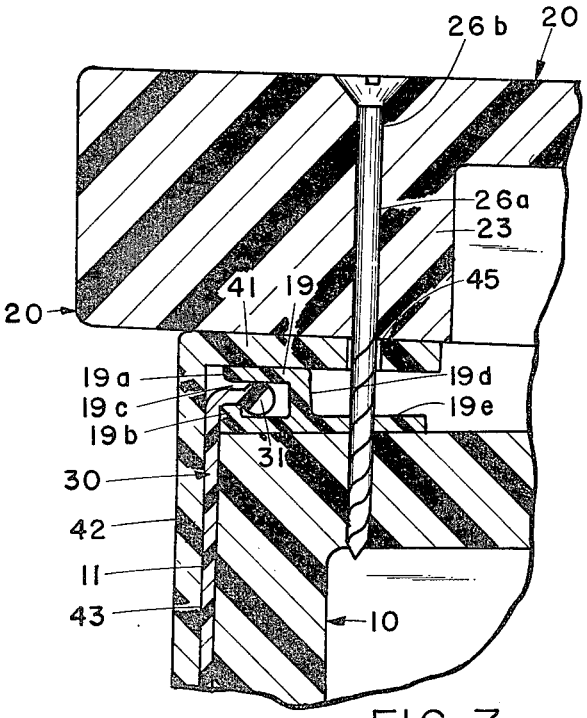
FIG. 7 is a further enlarged, fragmentary, vertical cross-sectional view of the swimming pool construction, particularly showing the facing member, and associated panels in an assembled condition.
Figure 6:
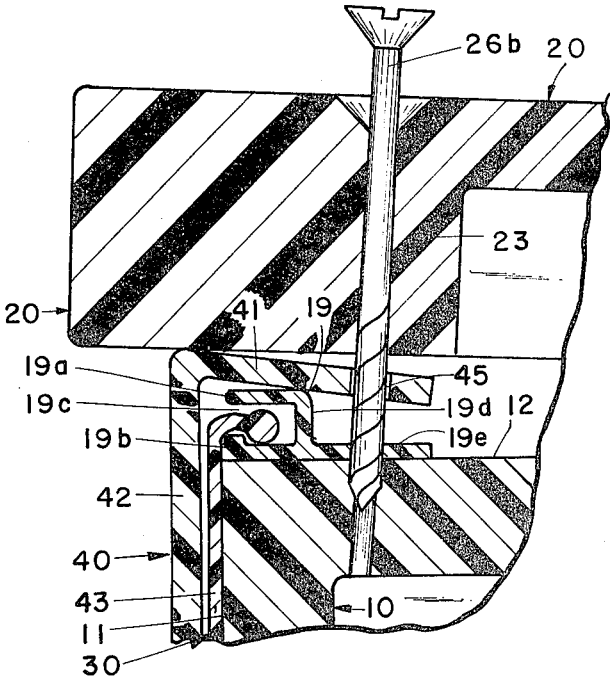
FIG. 6 is a further enlarged, fragmentary, vertical cross-sectional view of the swimming pool construction, particularly showing the facing member and associated panels in an unassembled condition.

As best illustrated in FIGS. 6 and 7, the facing member legs 41 and 42 are preferably mutually oriented at an acute angle, in the nature of 85 degrees, whereby the tightening of the fasteners 26*b* draws the vertical facing leg 42 firmly against the upper liner portion 43 for improved protection and a neat appearange. This feature is achieved as a result of the convergence of the flat lower surface of the deck panel 20 and the upper retainer flange 19*a*, with the horizontal facing leg 41 disposed therebetween. As deck panel 20 is drawn toward the upper flange of side wall panel 10, the vertical facing leg 41 is flattened into a substantially parallel relationship with the deck panel and the retainer upper flange 19*a*, which action draws the vertical facing leg 42 snugly against the liner upper portion 43, as shown in FIG. 7. The downward pressure applied by deck panel 20 on the retainer upper channel 19*a* as a result of the tightening of the fasteners 26*b* also tends to crush the retainer 19, thereby converging the upper and lower channels 19*a* and 19*b*, and closing the gap 19*c* to pinch or clamp the enlarged terminal portion 31 of the liner free edge therebetween. Hence, the tightening of the screws 26*b* along the interior periphery of the pool not only interconnects deck panels 20, facing member 41, retainer 19, and side wall panels 10, but also draws the facing member 40 securely against the upper portion 43 of the liner, and simultaneously clamps or captures the free edge 31 of the liner in the retainer 19.

The facing member 40 is preferably constructed of an elongate strip of extruded resilient material, such as vinyl, or the like, whereby the legs 41 and 42 are resilient. As the vertical leg 42 is drawn against the upper portion 43 of the liner 30, the liner upper portion 43 is resiliently urged into an abutting relationship with the upper portion of the side wall panels 10, thereby radially supporting and forming the liner upper portion 43.

Figure 5:
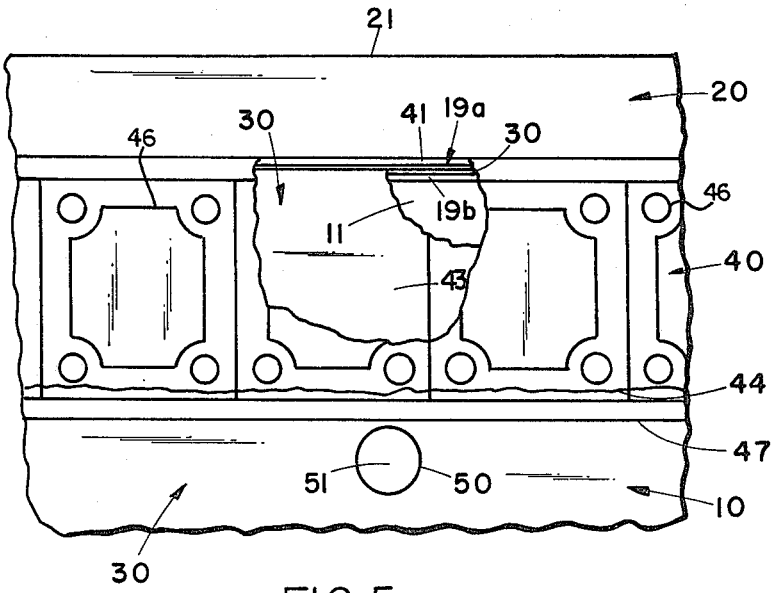
FIG. 5 is a fragmentary, front elevational view of a facing member portion of the swimming pool construction.

As best illustrated in FIG. 5, the exterior surface of the facing member 40 preferably includes a decorative pattern 46 thereon, and the lower terminal edge 47 of the facing member extends slightly below the surface of the water 44. In this manner, the liner 30 extends well above the surface of the water 44 to form a secure, water-tight reservoir. The upper portion 43 of the liner is covered by the facing member 40, and prevents weathering and other types of deterioration experienced as a result of exposure to environmental elements, as well as impact damage, such as that caused by skimming tools, floating toys, and other objects. In the illustrated example, an inlet aperture 50 is positioned through liner 30 and a side wall panel 10 at a position slightly below the surface of the water 44 to permit fresh water to be pumped into the pool. A plug 51 is provided to close the inlet aperture 50 when the same is not in use.

In use, the pool is installed by first forming a depression in the ground which is contoured in accordance with the desired shape of the pool. A ledge 55 (FIG. 1) is formed about the upper marginal edge of the pool, and foundation members 56, such as concrete blocks, or the like, are positioned therein, and the side wall panels 10 are arranged in an end-to-end fashion on the support blocks 56. The forward anchor rods 16 are then driven into the ground at the proper location until the same are rigidly anchored therein, and the side wall panels 10 are positioned thereover, with the upper ends of the rods 16 threaded through the apertures 15 in the lower flanges 13. The anchor rods 16 retain side wall panels 10 against horizontal translation. The side wall panels 10 and braces 60 are interconnected with fasteners 18, and a strip of material 71, such as tape, may be applied over each joint to prevent damage to the liner 30. In a similar manner, the outer rail 68 is anchored in the ground by rear anchors 64, and is positioned in a substantially parallel orientation with side wall panels 10 at a distance therebetween, such that the deck panels 20 extend between the rail 68 and side wall panels 10, and are supported thereon. The elevation of rail 68 is adjusted to be substantially level with the retainer upper flange 19*a*, and in the illustrated structure, is inclined slightly, in the nature of 2 degrees downwardly toward the outside of the pool construction to facilitate surface water drainage. Fasteners 67 and 69 connect the rail 68 and braces 60 with rear anchor 64. The free edge 31 of the liner 30 is then inserted between the flanges 19*a* and 19*b* of the retainer 19, and the horizontal leg 41 of facing member 40 is positioned over the upper retainer flange 19*a*. The deck panels 20 are then positioned over the frame, with the rearward flange 24 abutting the rail 68, and the forward flange 23 abutting the horizontal leg 41 of facing member 40. The forward edge of the deck panels 20 extends outwardly over the pool liner in the nature of a rim or lip. The fasteners 26*b* are then inserted through the mating deck panel apertures 26*a*, as well as facing apertures 45 and retainer 19, and are threadedly secured in the side wall upper flange 12. Fasteners 27*a* are threaded through apertures 27*b* and secured in the rail 68, so as to form a strong, rigid pool construction. The apertures for the fasteners 26*b* and 27*b* may be drilled in place, at the sight of pool assembly if desired. A free edge of the pool closure 30 is then connected in the mating channel member 28, thereby forming a substantially air-tight seal therebetween, such that pressurized air can be used to inflate the closure. The installation of the pool is then completed by backfilling dirt against the exterior surface of the rail 68, so as to impart a permanent appearance to the pool structure.

In the foregoing description, it will be readily appreciated by those skilled in the art that many modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows:

1. In a removable swimming pool construction including a plurality of side wall panels, deck panels, and a flexible liner, the improvement comprising:

a facing member connected between said side wall panels and said deck panels, and extending about an inside marginal edge of said pool construction; said facing member depending from said deck panels to a point disposed normally in the vicinity of the water line of said pool construction, and overlying an associated upper portion of said flexible liner for alleviating deterioration and damage thereto, and wherein said flexible liner includes a free edge connected with an upper portion of said side wall panels; and said facing member is substantially L-shaped, and includes one leg thereof disposed between said deck panels and said side wall panels, with the other leg depending therefrom and overlying the upper portion of said liner.

2. A swimming pool construction as set forth in claim 1 including:

fasteners spaced along the marginal edge of said pool construction, and extending through an associated one of said deck panels, facing member one leg, and side wall panels, thereby simultaneously interconnecting the same.

3. A swimming pool construction as set forth in claim 1 or 2 wherein:

said legs are disposed at an acute angle, such that when said one leg is sandwiched between said deck and side wall panels, said other leg is forced tightly against said upper portion of said liner and an associated upper portion of said side wall.

4. A swimming pool construction as set forth in claim 3, wherein:

said facing member legs are mutually oriented at an angle of substantially 85 degrees.

5. A swimming pool construction as set forth in claim 4 including:

a channel-shaped retainer mounted on an upper surface of said front wall panels, and including upper and lower horizontally oriented flanges between which the free edge of said flexible liner is positioned; and wherein said facing member one leg overlies said retainer upper flange, whereby tightening of said fasteners converges said retainer flanges and captures the liner free edge therebetween.

6. A swimming pool construction as set forth in claim 5 wherein:

said facing member other leg includes an exterior surface with a decorative pattern thereon.

7. In a removable swimming pool construction including a plurality of side wall panels, deck panels, and a flexible liner, the improvement comprising:

a facing member connected between said side wall panels and said deck panels, and extending about an inside marginal edge of said pool construction; said facing member depending from said deck panels to a point disposed normally in the vicinity of the water line of said pool construction, and overlying an associated upper portion of said flexible liner for alleviating deterioration and damage thereto; and means for retaining the upper portion of said flexible liner abuttingly against an associated upper portion of said side wall panels for radially supporting the liner upper portion.

8. A swimming pool construction as set forth in claim 7 wherein:

said liner retaining means comprises said facing member having a substantially L-shaped body comprised of two legs, one being a resilient leg overlying the upper portion of said liner which urges said liner upper portion abuttingly against the upper portion of said side wall panels.

9. A swimming pool construction as set forth in claim 8 wherein:

the other leg of said L-shaped body is disposed between said deck panels and said side wall panels; and including fasteners spaced along the marginal edge of said pool construction, and extending through an associated one of said deck panels, facing member other leg, and side wall panels thereby simultaneously interconnecting the same.

10. In a removable swimming pool construction including a plurality of side wall panels, deck panels, and a flexible liner, the improvement comprising:

a facing member connected between said side wall panels and said deck panels, and extending about an inside marginal edge of said pool construction; said facing member depending from said deck panels to a point disposed normally in the vicinity of the water line of said pool construction, and overlying an associated upper portion of said flexible liner for alleviating deterioration and damage thereto; and means for supporting said side wall panels at a predetermined height above the bottom of the pool construction;

a plurality of braces interconnecting and supporting said deck panels and said side wall panels; each of said braces comprising a substantially flat plate having one leg thereof positioned between and connected with a pair of adjacent side wall panels at an inward side of said deck panels, and another leg extending radially outwardly beneath said deck panels, and including an exterior end thereof connected with a rear ground anchor; and means rigidly retaining said brace legs in a predetermined angular relationship, whereby said braces support said deck panels thereon and simultaneously anchor said side wall panels.

11. A swimming pool construction as set forth in claim 10, wherein:

said brace leg retaining means comprises a triangular medial portion of said brace, formed integrally with said brace legs.

12. A swimming pool construction as set forth in claim 10 or 11 including:

front anchor posts spaced around said pool construction, oriented substantially vertically, and having a lower end shaped for engagement in the ground, and an upper end received in an aligned aperture formed in a lower flange portion of an associated one of said side wall panels.

13. A swimming pool construction as set forth in claim 12 including:

first and second fasteners interconnecting adjacent side wall panels with an associated brace therebetween; said fasteners being spaced apart, whereby said front anchor posts prevent lateral motion of said deck panels and said side wall panels, and said rear ground anchors prevent vertical motion and rotational motion of said deck and side wall panels.

14. In a removable swimming pool construction including a plurality of side wall panels, deck panels, and a flexible liner, the improvement comprising:

a facing member connected between said side wall panels and said deck panels, and extending about an inside marginal edge of said pool construction; said facing member depending from said deck panels to a point disposed normally in the vicinity of the water line of said pool construction, and overlying an associated upper portion of said flexible liner for alleviating deterioration and damage thereto;

said legs being disposed at an acute angle, such that when said one leg is sandwiched between said deck and side wall panels, said other leg is forced tightly against said upper portion of said liner and an associated upper portion of said side wall;

a channel-shaped retainer mounted on an upper surface of said front wall panels, and including upper and lower horizontally oriented flanges between which the free edge of said flexible liner is positioned; and wherein said facing member one leg overlies said retainer upper flange, whereby tightening of said fasteners converges said retainer flanges and captures the liner free edge therebetween.

15. A swimming pool construction as set forth in claim 1 wherein:

said facing member other leg includes an exterior surface with a decorative pattern thereon.

16. A swimming pool construction as set forth in claim 3 wherein:

said facing member other leg includes an exterior surface with a decorative pattern thereon.

17. A swimming pool construction as set forth in claim 3 including:

means for retaining the upper portion of said flexible liner abuttingly against an associated upper portion of said side wall panels for radially supporting the liner upper portion.

18. A swimming pool construction as set forth in claim 17 wherein:

said liner retaining means comprises said facing member.

* * * * *

UNITED STATES PATENT AND TRADEMARK OFFICE

CERTIFICATE OF CORRECTION

PATENT NO. : 4,343,118

DATED : August 10, 1982

INVENTOR(S) : Jay A. Lankheet

It is certified that error appears in the above—identified patent and that said Letters Patent is hereby corrected as shown below:

Column 4, line 46:

"appearange" should be --appearance--

Signed and Sealed this

*Twenty-second* Day of *February 1983*

[SEAL]

*Attest:*

GERALD J. MOSSINGHOFF

*Attesting Officer*

*Commissioner of Patents and Trademarks*